US006685881B2

(12) United States Patent
Hamano et al.

(10) Patent No.: US 6,685,881 B2
(45) Date of Patent: Feb. 3, 2004

(54) STAINLESS CAST STEEL HAVING GOOD HEAT RESISTANCE AND GOOD MACHINABILITY

(75) Inventors: Shuji Hamano, Tokai (JP); Michio Okabe, Chita (JP)

(73) Assignee: Daido Steel Co., Ltd., Nagoya (JP)

( * ) Notice: Subject to any disclaimer, the term of this patent is extended or adjusted under 35 U.S.C. 154(b) by 0 days.

(21) Appl. No.: 09/956,108

(22) Filed: Sep. 20, 2001

(65) Prior Publication Data

US 2002/0061257 A1 May 23, 2002

(30) Foreign Application Priority Data

Sep. 25, 2000 (JP) ..... 2000-289872

(51) Int. Cl.[7] ..... C22C 38/44; C22C 38/48; C22C 38/60

(52) U.S. Cl. ..... 420/42; 420/41; 420/47; 420/584.1; 420/585; 420/586; 420/586.1

(58) Field of Search ..... 420/57, 69, 97, 420/122, 42, 41, 47, 584.1, 585, 586, 586.1; 148/327

(56) References Cited

U.S. PATENT DOCUMENTS 4,363,660 A * 12/1982 Wakita et al. ..... 420/12
4,615,658 A * 10/1986 Kagohara et al. ..... 415/178
4,814,140 A * 3/1989 Magee, Jr. ..... 420/56
5,152,850 A * 10/1992 Takahashi et al. ..... 148/325
5,582,657 A * 12/1996 Watanabe et al. ..... 148/325

FOREIGN PATENT DOCUMENTS

GB 2051125 A * 1/1981 ..... C22C/38/40

* cited by examiner

*Primary Examiner*—Deborah Yee
(74) *Attorney, Agent, or Firm*—Varndell & Varndell, PLLC

(57) ABSTRACT

Disclosed is an austenitic stainless cast steel which has such a good heat resistance as can be used at a high temperature higher than 950° C. and a good machinability. The stainless cast steel consists essentially of, by weight %, C: 0.2–0.4%, Si: 0.5–2.0%, Mn: 0.5–2.0%, P: up to 0.10%, S: 0.04–0.2%, Ni: 8.0–42.0%, Cr: 15.0–28.0%, W: 0.5–7.0%, Nb: 0.5–2.0%, Al: up to 0.02%, Ti: up to 0.05%, N: up to 0.15%, Se: 0.001–0.50% and the balance of Fe and inevitable impurities.

4 Claims, No Drawings

STAINLESS CAST STEEL HAVING GOOD HEAT RESISTANCE AND GOOD MACHINABILITY

BACKGROUND OF THE INVENTION

1. Field in the Industry

The present invention concerns stainless cast steel having good heat resistance and good machinability. The stainless cast steel according to the invention is suitable as the material for parts which is subjected to repeated heating to a high temperature such as exhaust gas manifolds of automobile engines, turbine housings, connecting parts thereof, and exhaust gas cleaning devices.

2. State of the Art

To date, as the material for the parts such as exhaust gas manifolds of automobile engines, to which heat resistance is required, speroidal graphite cast iron has been generally used. For the use of extremely high exhaust gas temperature "Niresist" cast iron (C: 2.5–3.0%, Si:1.4–1.8%, Cu: 6–8%, Ni: 13–16%, Cr: 1.5–2.4%, Fe: balance) or ferritic stainless steel cast iron (JIS G SC1 to SC3) have been used.

It is the recent demand to imporove efficiency of automobile engines, and to meet this demand, temperature of exhaust gas is getting higher. Further, regulation on automobile exhaust gas is becoming stricter. Thus, it is necessary to treat the exhaust gas of higher temperature. The above mentioned conventional materials cannot be used for the parts of exhaust gas-treating devices, because deformation and/or crack caused by heat may occur. At a temperature higher than 950° C., ferritic stainless cast steel can no longer be used due to the decreasing strength, and therefore, austenitic stainless cast steel has been used. However, known austenitic stainless cast steels are so prepared as to focus on improvement in creep strength, and very few was developed to confront with the thermal fatigue resistance, which is required to the parts subjected to repeated heating. Only the heat resistant stainless cast steel disclosed in Japanese patent disclosure No. 54-96418 can be pointed out as an example of such steel.

The stainless cast steel disclosed in the above patent disclosure gazette has an alloy composition consisting of C: 0.1–1.5%, Si: 0.5–5.0%, Mn: up to 2.5%, Ni: 8–45%, Cr: 15–35%, W: 0.5–3/0%, and optionally, Mo: 0.5–2.0% or S: 0.05–0.25%, and Fe: balance. Though the steel has excellent heat resistance, the tensile strength of the steel at a temperature higher than 950° C. is insufficient, and the machinability is dissatisfactory. Improvement in these properties has been thus demanded.

The inventors carried out research and development to meet this demand and discovered that choosing the contents of C, Ni, Cr, W and Nb of an austenitic stainless cast steel to particular ranges will result in good high temperature strength, thermal fatigue resistance and oxidation resistance, and that addition of Se will, even if S-content is decreased, improve machinability.

SUMMARY OF THE INVENTION

The object of the present invention is to solve the above problems and to provide, on the basis of the above noted discovery by the inventors, an austenitic stainless cast steel having such a good heat resistance as can be used at a high temperature exceeding 950° C. as well as a good machinability. The stainless cast steel according to the invention, as a basic alloy composition, consists essentially of, by weight %, C: 0.2–0.4%, Si: 0.5–2.0%, Mn: 0.5–2.0%, P: up to 0.10%, S: 0.04–0.2%, Ni: 8.0–42.0%, Cr: 15.0–28.0%, W: 0.5–7.0%, Nb: 0.5–2.0%, Al: up to 0.02%, Ti: up to 0.05%, N: up to 0.15%, Se: 0.001–0.50% and the balance of Fe and inevitable impurities.

DETAILED EXPLANATION OF THE PREFERRED EMBODIMENTS

The stainless cast steel according to the invention may contain, in addition to the above basic alloy components, one or both of the element or elements of the following groups:

I) one or more of Mo: up to 2.0%, Zr: up to 0.05%, B: up to 0.100% and Co: up to 10.0%; and II) one or both of Ca: up to 0.10% and REM: up to 0.50%.

The reasons for limiting the content ranges of the alloy compositions are described below:

C: 0.2–0.4%

Carbon combines with niobium and/or tungsten to form carbides, which improves high temperature strength and thermal fatigue resistance. In order to obtain these effects it is necessary to have carbon contained at a content of 0.2% or higher. Excess carbon of a content exceeding 0.4% will combine with chromium to decrease Cr-content in the matrix of steel and oxidation resistance of the steel will become low. A preferable C-content is in the range of 0.25–0.33%.

Si: 0.5–2.0%

Silicon improves oxidation resistance of the steel and fluidity at the state of molted steel. These merits can be observed at a content of 0.5% Si or higher, while the Si-content exceeding 2.0% lowers stability of the austenitic phase and toughness of the steel.

Mn: 0.5–2.0%

Manganese improves oxidation resistance and further, combines with S and Se to form inclusions in the steel, which are useful for improving machinability. To ensure these effects, addition of Mn in an amount of 0.5% or more is necessary. Too much addition exceeding 2.0% will result in decreased toughness. A preferable range of Mn-content is 0.8–1.5%.

P: up to 0.10%

Phosphor is one of the components which contribute to the machinability of the steel. However, if the amount of phosphor exceeds 0.10%, oxidation resistance and toughness of the steel will be seriously damaged, and thus, P-content should be limited to the upper limit of 0.10% or less.

S: 0.04–0.2%

Sulfur forms with manganese MnS, which improves machinability of the steel. The least amount of sulfur giving this effect is 0.04%. S-content larger than 0.2% causes serious decrease in toughness and ductility. A preferable range of S-content is 0.06–0.14%.

Ni: 8.0–42.0%,

Nickel makes the matrix austenite phase of the steel stable and increases heat resistance and corrosion resistance of the alloy. Therefore, at least 8.0% of Ni is added to this steel. At a larger amount the effects will saturate and the costs will be higher. The upper limit is thus set to 42.0%. A preferable range of Ni-content is 10–40%.

Cr: 15.0–28.0%,

Chromium, forming carbides with carbon, remarkably improves high temperature strength and oxidation resistance of the steel. The merit will be given by addition of chromium of 15% or higher. At a higher Cr-content the effect saturates and further, accelerates formation of σ-phase, which makes the steel brittle. Thus, 28.0% is the upper limit. A preferable range of Cr-content is 19–26%.

W: 0.5–7.0%

TUNGSTEN forms carbide with carbon to remarkably improve high temperature strength and thermal fatigue resistance. Carbide-forming ability of W is higher than that of Cr, and thus, tungsten prevents decrease of Cr existing in the austenitic phase of the matrix and contributes to maintain high oxidation resistance. This effect of W can be obtained by addition of 0.5% or more. Too much addition will, on the other hand, damages oxidation resistance and toughness of the steel. From this point of view, 7.0% is set as the upper limit. A preferable W-content is in the range of 1–6%.

Nb: 0.5–2.0%,

Niobium forms, like tungsten, carbide with carbon and highly increases high temperature strength and thermal fatigue resistance. Carbide-forming ability of niobium is, like that of tungsten, also higher than that of chromium, and therefore, prevents decrease of Cr-amount in the austenitic phase constructing the matrix and maintains the oxidation resistance of the steel high.

Al: up to 0.02%

Aluminum contributes to improvement of oxidation resistance of the steel. Addition of Al exceeding 0.02% decreases fluidity of the molten steel and seriously damages toughness.

Ti: up to 0.05%,

Titanium also forms carbide with carbon to contribute to improvement in high temperature strength and thermal fatigue resistance.

N: up to 0.15%

Nitrogen contributes to the strength and the stability of austenitic phase of the steel. At an N-content exceeding 0.15% the thermal fatigue resistance of the steel decreases, and the toughness and ductility also decrease.

Se: 0.001–0.50%

Selenium is necessary because it, like sulfur, combines with manganese to form inclusions, which improve machinability of the steel. The effect can be observed at such a low content of Se as 0.001%, and at a higher content exceeding 0.50% high temperature strength, toughness and ductility, and thermal fatigue resistance decrease. Also, costs of the stainless steel will be higher.

The following is explanation of the effects of further alloy components which can be optionally added and the reasons for limiting the ranges of the contents in the steel.

Mo: up to 2.0%

Molybdenum dissolves in the austenitic phase to increase high temperature strength of the steel. Mo in an amount higher than 2.0% seriously lowers oxidation resistance at a temperature higher than 900° C., and further, toughness and ductility of the steel decrease. The Mo-content is thus set to be up to 2.0%. A preferable Mo-content is up to 1.8%.

Zr: up to 0.05%

Zirconium prevents crystal grains and eutectic carbide particles from coarsening, and improves high temperature strength and thermal fatigue resistance. Addition of a large amount of Zr significantly decreases toughness and ductility of the steel, and therefore, the upper limit of Zr-addition is set to 0.05%.

B: up to 0.100%

Boron strengthens crystal boundaries of the steel to improve high temperature strength. Addition of a large amount of B exceeding 0.10% considerably lowers oxidation resistance, toughness and ductility, as well as thermal fatigue resistance of the steel.

Co: up to 10.0%

Cobalt stabilizes austenitic phase of the steel, increases the high temperature strength by solution strengthening, and improves corrosion resistance. These effects saturate at a higher Co-content, and addition exceeding 10.0% loses the significance and increases costs of the steel.

Ca: up to 0.10%

Calcium combines with oxygen to form the oxide, which improves machinability of the steel. Addition of Ca in the amount exceeding 0.10% decreases toughness and ductility, and thermal fatigue resistance of the steel.

REM: up to 0.50%

REM improves oxidation resistance of the steel. Addition of REM in an amount more than 0.50% damages toughness and ductility, and markedly decreases thermal fatigue resistance of the steel.

EXAMPLES

Stainless cast steels of the alloy compositions shown in Table 1 (Examples) and Table 2 (Controls) were prepared by melting in an HF-induction furnace and the molten steels were cast into JIS-A test materials. The test materials were subjected to annealing by being heated to 1100° C. for 30 minutes, and then, test pieces for high temperature tensile tests, test pieces for thermal fatigue tests and test pieces for machinability tests were prepared from the annealed materials. Using these test pieces the high temperature tensile tests, the thermal fatigue tests and machinability tests were carried out in accordance with the methods and under the conditions described below.

[High Temperature Tensile Test]

Test Piece: gauge length 30 mm, diameter 6 mm

Temperature: 1050° C.

[Thermal Fatigue Test]

Disk type test piece: diameter 60 mm, thickness 10 mm

The test pieces were immersed in a fluidized bed of alumina powder heated to 1050° C. for 3 minutes, and then, quickly transferred into a fluidized bed of alumina powder at 150° C. and maintained therein for 4 minutes. After 500 times repetition of this cycle, the sum of crack length in each test piece was measured.

[Machinability Test]

Milling was carried out by using cemented carbide tools with carbide tips, and total cutting length until abrasion of the carbide tips runs up to 200 $\mu$m. The results are shown relative to the data on HK40 (Control 5), a typical austenitic stainless cast steel.

TABLE 1

| | Examples (wt. %, balance Fe) | | | | | | | | | | | | |
|---|---|---|---|---|---|---|---|---|---|---|---|---|---|
| No. | C | Si | Mn | P | S | Ni | Cr | W | Nb | Al | Ti | Se | N |
| 1 | 0.31 | 1.02 | 1.22 | 0.028 | 0.087 | 40.4 | 25.1 | 6.01 | 1.50 | 0.011 | 0.004 | 0.010 | 0.042 |
| 2 | 0.28 | 1.04 | 1.16 | 0.029 | 0.063 | 39.8 | 25.0 | 4.03 | 1.61 | 0.007 | 0.006 | 0.032 | 0.046 |
| 3 | 0.30 | 0.98 | 1.86 | 0.045 | 0.133 | 38.9 | 23.4 | 6.95 | 1.72 | 0.007 | 0.013 | 0.006 | 0.035 |

Mo 1.8, B 0.04, REM 0.41

TABLE 1-continued

| Examples (wt. %, balance Fe) | | | | | | | | | | | | | |
|---|---|---|---|---|---|---|---|---|---|---|---|---|---|
| No. | C | Si | Mn | P | S | Ni | Cr | W | Nb | Al | Ti | Se | N |
| 4 | 0.30 | 0.90 | 1.17 | 0.029 | 0.089 | 35.2 | 25.3 | 1.65 | 1.44 | 0.009 | 0.006 | 0.012 | 0.041 |
| 5 | 0.32 | 1.08 | 1.09 | 0.026 | 0.058 | 36.6 | 24.8 | 3.99 | 1.48 | 0.003 | 0.007 | 0.023 | 0.039 |
| 6 | 0.38 | 0.96 | 1.56 | 0.023 | 0.107 | 35.1 | 27.3 | 6.56 | 0.96 | 0.003 | 0.008 | 0.006 | 0.038 |
| | | | | | | | | | Mo 0.9, Zr 0.04, Ca 0.08, REM 0.41 | | | | |
| 7 | 0.30 | 0.92 | 1.30 | 0.027 | 0.078 | 30.3 | 25.1 | 4.13 | 1.51 | 0.005 | 0.007 | 0.008 | 0.033 |
| 8 | 0.31 | 0.97 | 1.07 | 0.031 | 0.075 | 31.9 | 25.6 | 4.01 | 1.33 | 0.006 | 0.009 | 0.007 | 0.048 |
| 9 | 0.29 | 1.76 | 0.78 | 0.020 | 0.067 | 28.7 | 23.9 | 1.20 | 0.61 | 0.006 | 0.017 | 0.010 | 0.046 |
| | | | | | | | | | Mo 1.2, Zr 0.03, Co 5.2, Ca 0.08 | | | | |
| 10 | 0.28 | 1.03 | 1.21 | 0.029 | 0.078 | 24.7 | 24.9 | 0.58 | 1.89 | 0.008 | 0.004 | 0.006 | 0.035 |
| 11 | 0.30 | 1.07 | 1.33 | 0.028 | 0.083 | 25.0 | 25.0 | 3.92 | 1.73 | 0.006 | 0.007 | 0.018 | 0.043 |
| 12 | 0.23 | 0.99 | 1.28 | 0.028 | 0.129 | 25.7 | 26.3 | 2.99 | 1.18 | 0.005 | 0.009 | 0.006 | 0.037 |
| | | | | | | | | | Zr 0.04, B 0.04, Ca 0.07, REM 0.41 | | | | |
| 13 | 0.27 | 0.81 | 0.90 | 0.027 | 0.090 | 20.3 | 25.2 | 3.99 | 1.52 | 0.005 | 0.004 | 0.007 | 0.029 |
| 14 | 0.28 | 0.67 | 0.82 | 0.031 | 0.076 | 19.8 | 24.6 | 1.03 | 0.97 | 0.008 | 0.007 | 0.006 | 0.044 |
| 15 | 0.31 | 0.90 | 1.25 | 0.033 | 0.098 | 21.0 | 22.7 | 3.70 | 1.48 | 0.016 | 0.009 | 0.009 | 0.043 |
| | | | | | | | | | | Mo 1.7, Co 9.4, REM 0.40 | | | |
| 16 | 0.27 | 1.01 | 0.98 | 0.030 | 0.115 | 14.7 | 24.6 | 4.02 | 1.08 | 0.007 | 0.006 | 0.029 | 0.043 |
| 17 | 0.25 | 0.86 | 0.74 | 0.031 | 0.102 | 11.9 | 25.3 | 3.03 | 1.02 | 0.008 | 0.007 | 0.023 | 0.046 |
| 18 | 0.28 | 0.95 | 0.99 | 0.030 | 0.099 | 15.2 | 20.1 | 2.11 | 0.89 | 0.008 | 0.009 | 0.033 | 0.048 |
| 19 | 0.29 | 0.99 | 0.80 | 0.028 | 0.105 | 11.5 | 19.8 | 1.02 | 0.71 | 0.007 | 0.007 | 0.032 | 0.038 |

TABLE 2

| Controls (wt. %, balance Fe) | | | | | | | | | | | | | |
|---|---|---|---|---|---|---|---|---|---|---|---|---|---|
| No. | C | Si | Mn | P | S | Ni | Cr | W | Nb | Al | Ti | Se | N |
| 1 | 0.31 | 1.12 | 1.18 | 0.022 | 0.021 | 41.7 | 25.5 | 2.90 | 1.44 | 0.004 | 0.008 | 0.022 | 0.034 |
| 2 | 0.31 | 1.03 | 0.98 | 0.040 | 0.320 | 34.6 | 24.6 | 3.87 | 1.53 | 0.007 | 0.004 | 0.008 | 0.036 |
| 3 | 0.30 | 0.94 | 1.33 | 0.030 | 0.092 | 29.5 | 24.4 | 0.39 | 0.41 | 0.006 | 0.006 | 0.010 | 0.032 |
| 4 | 0.31 | 0.89 | 1.13 | 0.031 | 0.150 | 23.3 | 25.4 | 7.89 | 2.96 | 0.006 | 0.005 | 0.038 | 0.042 |
| 5 | 0.31 | 0.77 | 0.79 | 0.024 | 0.005 | 20.2 | 25.1 | 0.01 | 0.01 | 0.004 | 0.004 | | 0.038 |
| 6 | 0.31 | 0.77 | 0.79 | 0.024 | 0.005 | 7.2 | 19.8 | 0.01 | 0.01 | 0.004 | 0.004 | 0.033 | 0.033 |
| 7 | 0.31 | 0.77 | 0.79 | 0.024 | 0.005 | 10.5 | 13.4 | 0.01 | 0.01 | 0.004 | 0.004 | 0.035 | 0.038 |

TABLE 3

| Examples | | | |
|---|---|---|---|
| No. | High Temperature Tensile Strength (MPa) | Total Crack Length by Thermal Fatigue (mm) | Tool Life relative to HK40 |
| 1 | 87 | 92 | 2.5 |
| 2 | 87 | 93 | 2.7 |
| 3 | 88 | 90 | 3.1 |
| 4 | 84 | 91 | 2.4 |
| 5 | 85 | 94 | 2.3 |
| 6 | 84 | 93 | 2.4 |
| 7 | 83 | 95 | 2.4 |
| 8 | 83 | 93 | 2.2 |
| 9 | 81 | 99 | 1.9 |
| 10 | 84 | 98 | 2.4 |
| 11 | 81 | 92 | 2.5 |
| 12 | 80 | 100 | 2.9 |
| 13 | 80 | 110 | 2.2 |
| 14 | 82 | 105 | 2.0 |
| 15 | 79 | 106 | 2.4 |
| 16 | 79 | 108 | 2.2 |
| 17 | 78 | 110 | 2.1 |
| 18 | 78 | 111 | 2.3 |
| 19 | 77 | 112 | 2.3 |

TABLE 4

| Controls | | | |
|---|---|---|---|
| No. | High Temperature Tensile Strength (MPa) | Total Crack Length by Thermal Fatigue (mm) | Tool Life relative to HK40 |
| 1 | 86 | 108 | 0.9 |
| 2 | 72 | 182 | 2.3 |
| 3 | 70 | 145 | 1.8 |
| 4 | 84 | 167 | 1.7 |
| 5 | 69 | 160 | 1.0 |
| 6 | 63 | 163 | 1.8 |
| 7 | 60 | 171 | 1.9 |

The problems in the Controls shown in Table 4 were caused by the reasons described below:

In Control 1, S-content is too low and thus, though the high temperature tensile strength is good, machinability is insufficient. In the contrary, Control 2 contains too much sulfur to have good machinability, and dissatisfactory high temperature tensile strength. Control 3 is, due to low W-content and Nb-content, inferior in high temperature tensile strength. On the other hand, Control 4 contains too much Wand Nb, and, though the high temperature strength is high, crack by thermal fatigue tends to occur. Control 5, which contains neither W nor Nb, and due to low S-content, high temperature strength is low and machinability is dissatisfactory. In Control 6, because of too small addition of Ni, high temperature strength is low and crack easily occurs. Control 7, due to shortage of Cr, also inferior in regard to high temperature strength and cracking tendency.

Examples 1 to 19 of the invention are, in comparison with the Controls, superior in the high temperature strength and thermal fatigue resistance at 1050° C. Also, machinability of the present steel is so good that the tool lives on the basis of the machinability of HK40 are twice or more.

These superior characteristics are achieved by choice of the above described particular alloy compositions.

We claim:

1. A stainless cast steel having good heat resistance and good machinability, which consists essentially of, by weight %, C: 0.2–0.4%, Si: 0.5–2.0%, Mn: 0.5–2.0%, P: up to 0.10%, S: 0.04–0.2%, Ni: 8.0–42.0%, Cr: 15.0–28.0%, W: 0.5–7.0%, Nb: 0.6–2.0%, Al: up to 0.02%, Ti: up to 0.05%, N: up to 0.15%, Se: 0.001–0.50% and the balance of Fe and inevitable impurities.

2. A stainless cast steel having good heat resistance and good machinability, which consists essentially of, by weight %, C: 0.2–0.4%, Si: 0.5–2.0%, Mn: 0.5–2.0%, P: up to 0.10%, S: 0.04–0.2%, Ni: 8.0–42.0%, Cr: 15.0–28.0%, W: 0.5–7.0%, Nb: 0.6–2.0%, Al: up to 0.02%, Ti: up to 0.05%, N: up to 0.15%, Se: 0.001–0.50% and further, one or more of Mo: up to 2.0%, Zr: up to 0.05%, B: up to 0.10% and Co: up to 10.0%, and the balance of Fe and inevitable impurities.

3. A stainless cast steel having good heat resistance and good machinability, which consists essentially of, by weight %, C: 0.2–0.4%, Si: 0.5–2.0%, Mn: 0.5–2.0%, P: up to 0.10%, S: 0.04–0.2%, Ni: 8.0–42.0%, Cr: 15.0–28.0%, W: 0.5–7.0%, Nb: 0.6–2.0%, Al: up to 0.02%, Ti: up to 0.05%, N: up to 0.15%, Se: 0.001–0.50% and further, one or both of Ca: up to 0.10% and REM: up to 0.50%, and the balance of Fe and inevitable impurities.

4. A stainless cast steel having good heat resistance and good machinability, which consists essentially of, by weight %, C: 0.2–0.4%, Si: 0.5–2.0%, Mn: 0.5–2.0%, P: up to 0.10%, S: 0.04–0.2%, Ni: 8.0–42.0%, Cr: 15.0–28.0%, W: 0.5–7.0%, Nb: 0.6–2.0%, Al: up to 0.02%, Ti: up to 0.05%, N: up to 0.15%, Se: 0.001–0.50%; and further, one or more of Mo: up to 2.0%, Zr: up to 0.05%, B: up to 0.10% and Co: up to 10.0%; and still further, one or both of Ca: up to 0.10% and REM: up to 0.50%; and the balance of Fe and inevitable impurities.

* * * * *